United States Patent [19]

Kersten et al.

[11] Patent Number: 5,059,807

[45] Date of Patent: Oct. 22, 1991

[54] PROTECTION BARRIER AGAINST IONIZING RAYS OF THE $\gamma$ TYPE AND/OR X-RAYS

[75] Inventors: Jean Kersten, Villers-St.-Amand; Etienne Lombard, Genappe; Christian Carlier, Brussels, all of Belgium

[73] Assignee: Baxter International Inc., Deerfield, Ill.

[21] Appl. No.: 435,512

[22] PCT Filed: Mar. 17, 1989

[86] PCT No.: PCT/US89/01094

§ 371 Date: Nov. 21, 1989

§ 102(e) Date: Nov. 21, 1989

[87] PCT Pub. No.: WO89/09472

PCT Pub. Date: Oct. 5, 1989

[30] Foreign Application Priority Data

Mar. 24, 1988 [BE] Belgium ..... 08800334

[51] Int. Cl.[5] ..... G21F 3/02

[52] U.S. Cl. ..... 250/519.1; 250/516.1

[58] Field of Search ..... 250/515.1, 516.1, 519.1

[56] References Cited

U.S. PATENT DOCUMENTS

| | | | |
|---|---|---|---|
| 2,328,105 | 8/1943 | Strobino | 250/516.1 |
| 2,971,095 | 2/1961 | Drummond . | |
| 3,052,799 | 9/1962 | Hollands | 250/516.1 |
| 3,185,751 | 5/1965 | Sutton | 250/516.1 |
| 3,883,749 | 5/1975 | Whittaker et al. . | |
| 4,910,090 | 3/1990 | Kuhlman et al. | 428/469 |
| 4,938,233 | 7/1990 | Orrison | 250/516.1 |

FOREIGN PATENT DOCUMENTS

| | | |
|---|---|---|
| 1119926 | 6/1956 | France . |
| 53-105700 | 9/1978 | Japan . |

*Primary Examiner*—Bruce C. Anderson

*Attorney, Agent, or Firm*—Kay H. Pierce; Paul C. Flattery

[57] ABSTRACT

Protection barrier against ionizing rays of the $\gamma$ type and/or X-rays comprising a flexible sheet (2) in which particles (3) of an agent absorbing said rays are dispersed. The absorbing agent is selected among bismuth and the oxides, hydroxide and salts of bismuth and is particularly bismuth oxide of the formula $Bi_2O_3$ having a particle size of less than 10 microns (figure).

12 Claims, 1 Drawing Sheet

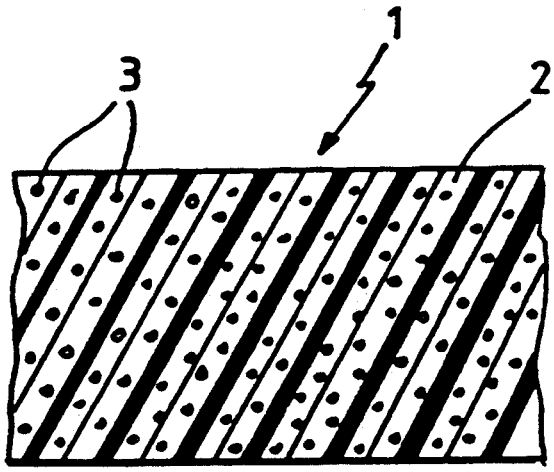
1
3
2

PROTECTION BARRIER AGAINST IONIZING RAYS OF THE γ TYPE AND/OR X-RAYS

The present invention relates to a protecting barrier against ionizing rays of the γ type and/or X-rays, comprising a flexible sheet in which particles of an agent absorbing said rays are dispersed.

Clothes and accessories protecting against X-rays are known from U.S. Pat. No. 3,883,749.

These clothes and accessories are made of a polymeric material having a thickness comprised between 125 and 625 microns and containing from 10 to 45% by weight of a X-ray absorbing agent selected among uranium dioxide, lead oxide and the mixtures thereof. This polymeric material is coated on both sides with a thin layer of polymeric material, these layers being not loaded with an absorbing agent.

These clothes and accessories according to U.S. Pat. No. 3,883,749 have several disadvantages, such as the following:

the use of lead oxide which is toxic;

the toxicity due to the lead needs the use of unloaded layers of polymeric material on both sides of the layer loaded with lead;

the toxicity due to the lead imposes additional investment for the manufacturer of such clothes and accessories in order to comply with the regulations relating to work safety or to the environmental protection, and a high cost.

An object of the present invention is to avoid these drawbacks.

The barrier of the type described in the first paragraph of the present specification is essentially characterized in that the absorbing agent is selected among the bismuth and the oxides, hydroxide and salts of bismuth. This agent is, preferably, the bismuth oxide and has a particle size lower than 40 microns, preferably lower than 10 microns and particularly lower than 5 microns.

According to a feature of the protection barrier according to the invention, the flexible sheet contains from 30 to 80% by weight of absorbing agent and is made of a polymeric material and, preferably, of a polyethylene having a density near to about 0.91.

Other features and details of the invention will appear from the following detailed description in which reference is made to the single figure of attached drawing which is a cross section of a part of a protection barrier according to the invention.

In this single FIGURE, a protection barrier designated generally by the reference 1, comprises a single flexible sheet 2 wherein particles 3 of an agent absorbing the ionizing rays of the § and/or X type are dispersed, this agent being selected among the bismuth and the oxides, hydroxide and salts of bismuth.

Due to the use of bismuth or of one of its oxides, hydroxide or salts, it is no more necessary to cover the protection barrier 1 with a layer intended to avoid the contact of a user with the absorbing agent, since the bismuth, its oxides, hydroxide and salts do not have the toxic character of the lead compounds.

The flexible sheet 2 is made of a polymeric material such as rubber, silicone, polyurethane, polyethylene, polypropylene or polyvinyl chloride. This sheet is preferably made of polyethylene and particularly of very low density linear polyethylene, so that this sheet has also an excellent absorption with respect to the neutrons.

This sheet 2 may contain from 30 to 80% by weight of particles of bismuth, bismuth oxides, bismuth hydroxide or bismuth salts. Proportions of absorbing agent particles of more than 60% by weight are possible, due to the use of particles having a particle size lower than 10 microns and preferably lower than 5 microns. Such a particle size may be obtained by micronizing or disintegration.

The particles of bismuth-containing absorbing agent may advantageously be coated with a silicone, such as polymethylsiloxane, this coating causing a better mechanical binding between these particles and the polymeric material.

Moreover, the use of particles having a particle size lower than 10 microns and, preferably, lower than 5 microns allows to obtain a flexible sheet 2, for example a sheet of polyethylene having a density equal to 0.906, loaded with 70% by weight which is homogeneous and which does not have surface irregularities.

Due to this homogeneous distribution of absorbing agent particles, the user has the benefit of an identical protection against the γ rays and/or the X-rays along the entire surface of the flexible sheet 2.

The thickness and the content of absorbing agent of the protection barrier against the ionizing rays of the γ type or X-rays, this barrier having the form of a flexible sheet, may vary according to the applications, the aimed protection factor, as well as in function of the intensity of the ionizing rays.

Thus, for example, for an operative field, the thickness may vary between 80 and 500 microns while, for gloves of surgeons or radiologists, it may vary between 80 and 300 microns and is preferably of about 200 microns.

For fine working, gloves having a thickness comprised between 80 and 130 microns are preferably used, since they take the exact shape of the hands of the practitioner.

For aprons or overalls, the thickness may be greater than 500 microns.

Other features of the protection barrier according to the invention will appear from the following tests:

TESTS 1

The following table I gives the percentage by weight of the heavy element such as the bismuth and the lead which allows the absorption of ionizing rays of the γ type and/or X-rays, for various absorbing agents.

TABLE I

| Absorbing agent | % by weight of the element allowing the absorption | |
|---|---|---|
| | Bi | Pb |
| $Bi_2O_3$ | 90 | |
| $Bi(OH)_3$ | 80 | |
| Pb O | | 93 |
| Pb $O_2$ | | 87 |
| $PbSO_4$ | | 68 |
| Pb Cr $O_4$ | | 64 |

This table I shows clearly that the bismuth oxide and the bismuth hydroxide contain substantially as much heavy elements able to absorb the γ and/or X- rays than the lead oxides. However, the bismuth derivatives have not the drawbacks in respect to pollution or toxicity that the lead derivatives have.

TESTS 2

These tests have been made in order to compare the absorption of a protection barrier according to the invention and that of a protection barrier containing lead for different radiations.

The protection barriers according to the invention were constituted of a flexible sheet of very low density polyethylene, in which bismuth oxide was dispersed. The polyethylene had a density of 0.906 and the bismuth oxide had a particle size lower than 5 microns and a purity of about 99.5%.

These protection barriers were compared to a commercial protection barrier used for the manufacture of gloves intended for medical applications. This latter protection barrier has a thickness of about 505 microns and is made of three layers, i.e. one layer containing lead or a lead derivative and two layers covering the lead-containing layer, so as to avoid toxicity or medical problems.

These different barriers were submitted to primary X-rays, i.e. the rays emitted directly from a tube.

The following table II gives the different results of absorption of the protection barriers.

TABLE II

| Material | thickness microns | % of absorption of X-rays having an energy of 75 kV | 100 kV | 125 kV |
|---|---|---|---|---|
| known product | 505 | 39.8 | 29.7 | 25.1 |
| polyethylene having a low density of 0.906 (without absorbing agent) | 125 | 0.3 | 0.4 | 0.3 |
| polyethylene (density: 0.906) loaded with 30% of $Bi_2O_3$ | 150 | 7.0 | 4.9 | 3.9 |
| polyethylene (density: 0.906) loaded with 60% of $Bi_2O_3$ | 100 | 12.1 | 8.3 | 7.1 |
| polyethylene (density: 0.906) loaded with 70% of $Bi_2O_3$ | 100 | 17.3 | 12 | 9.8 |
| | 150 | 25.4 | 18.7 | 15.6 |
| | 200 | 36.0 | 24.7 | 21.6 |

This table II shows clearly that it is possible to obtain an absorption identical to that of a known commercial protection barrier, when using a protection barrier according to the invention, having a thickness which is equal to the half of that of the commercial product.

In spite of the fact that the protection barrier has a small thickness, this high absorption level is possible by the use of absorbing agent particles having a particle size lower than 5 microns. Such a particle size allows to obtain a homogeneous material and allows to load the polyethylene with particles up to a percentage of 80% by weight.

TESTS 3

Tests have been made with the same protection barriers than those used in tests 2 for determining the static and dynamic friction coefficient of these different protection barriers.

The following table III gives the values of these friction coefficients:

TABLE III

| material | thickness microns | $\mu$ static | $\mu$ dynamic |
|---|---|---|---|
| known product | 505 | 1.5 | 1.51 |
| low density polyethylene | 125 | 0.91 | 0.81 |
| polyethylene loaded with 30% of $Bi_2O_3$ | 150 | 0.84 | 0.77 |
| polyethylene loaded with 60% of $Bi_2O_3$ | 100 | 0.74 | 0.69 |
| polyethylene loaded with 70% of $Bi_2O_3$ | 100 | 0.74 | 0.65 |
| | 150 | 0.71 | 0.69 |
| | 200 | 0.87 | 0.79 |

This table III shows the surprising benefic effect of the bismuth oxide on the friction coefficient, the addition of this absorbing agent allowing a decrease of the friction coefficient of polyethylene.

Due to this low friction coefficient, it is not necessary to put a product such as talc between two flexible sheets according to the invention for removing easily these sheets from each other.

Thus, this low friction coefficient allows to avoid the introduction of talc or another similar material in gloves so as to allow the user to pull on them easily. This allows also to avoid the problems of allergy due to the talc.

TESTS 4

These tests were made on the protection barriers used in the tests 3, in order to determine mechanical properties of the protection barrier according to the invention.

In these tests the tensile strength and the elongation at rupture of different protection barriers have been measured. The results of these tests are given in the following table IV:

TABLE IV

| material | thickness microns | tensile strength $N/mm^2$ | elongation at rupture % |
|---|---|---|---|
| polyethylene | 125 | 19.49 | 812 |
| polyethylene loaded with 30% of $Bi_2O_3$ | 150 | 16.45 | 833 |
| polyethylene loaded with 60% of $Bi_2O_3$ | 100 | 14.86 | 781 |
| polyethylene loaded with 70% of $Bi_2O_3$ | 100 | 12.08 | 742 |
| | 150 | 11.09 | 749 |
| | 200 | 9.12 | 691 |

The table IV shows that the use of particles of absorbing agent possibly covered with silane, having a particle size lower than 5 microns, allows the flexible sheet to keep good mechanical properties even if this sheet is loaded with more than 70% by weight of $Bi_2O_3$.

Due to the excellent mechanical properties of the protection barrier according to the invention, the use of outside layers unloaded with absorbing agents and intended to reinforce the structure of the barrier is useless.

The protection barrier against ionizing rays of the $\gamma$ type or/and X-rays according to the invention can be used for the manufacture of clothes or parts of clothes such as gloves mufflers, mittens, fingerstalls, aprons, bibs, caps, cowls, boots, overalls and the like or for the manufacture of surgical operative fields.

The protection barrier according to the invention can be easily producted by using, for example, an extruder or an injection equipment. For example, the extruder may comprise two screws for extruding said protection barrier. These screws are, moreover, useful for mixing the polymer and the bismuth-containing absorbing agent, so as to obtain an homogeneous blend.

The protection barrier according to the invention, which may be produced at low price, since the process for the manufacture thereof is very simple, the flexible sheet having not to be covered with protecting sheets, allows the manufacture of goods such as gloves, which are disposable after use.

This gives to the medical profession a higher degree of safety, since, after each surgical operation, the gloves according to the invention may be disposed of. Commercially known gloves must, on the contrary, be used and disinfected several times, due to their very high cost.

We claim:

1. Protection barrier against ionizing rays of the type and/or x-rays, comprising a flexible single layer polymeric film of between 50 and 500 microns, in thickness in which particles of an agent absorbing said rays are dispersed, characterized in that said ionizing ray absorbing agent is selected from the group consisting of particles of bismuth, bismuth oxide, bismuth hydroxide or bismuth salts, said particles having a size of less than 40 microns.

2. Protection barrier according to claim 1, characterized in that the absorbing agent is the bismuth oxide of the formula $Bi_2O_3$.

3. Protection barrier according to claim 1, characterized in that the flexible sheet contains from 30% to 80% by weight of absorbing agent.

4. Protection barrier according to claim 1, characterized in that the polymeric material is a polyolefin.

5. Protection barrier according to claim 4, characterized in that the polyolefin is a polyethylene.

6. Protection barrier according to claim 5, characterized in that the polyethylene has a density of about 0.91.

7. The protection barrier of claim 5 wherein said polyethylene has a tensile strength of at least about 9.12 $N/mm^2$.

8. Protection barrier according to claim 3 in the form of clothes or parts of clothes.

9. Protection barrier according to claim 7, characterized in that said clothes are gloves, mittens, mufflers, finger-stalls, caps, cowls, aprons, bibs, overalls and boots.

10. Protection barrier according to claim 3 in the form of surgical operative fields.

11. The protection barrier of claim 1 wherein said absorbing agent is coated with silicone.

12. The protection barrier of claim 1 wherein said particles are less than 10 microns.

* * * * *